US005118526A

United States Patent [19]

Allen et al.

[11] Patent Number: 5,118,526

[45] Date of Patent: Jun. 2, 1992

[54] METHOD OF PRODUCING A SIMULATED WATERMARK

[75] Inventors: Philip R. Allen, Sandwich; James E. Nangle, Norfolk, both of Mass.

[73] Assignee: Regal Press, Incorporated, Norwood, Mass.

[21] Appl. No.: 667,550

[22] Filed: Mar. 11, 1991

[51] Int. Cl.[5] ..... B05D 5/00; B05D 1/28

[52] U.S. Cl. ..... 427/161; 427/288

[58] Field of Search ..... 427/161, 288

[56] References Cited

U.S. PATENT DOCUMENTS

| | | | |
|---|---|---|---|
| 30,945 | 12/1860 | Karcheski | 8/115.6 |
| 130,676 | 8/1872 | Westerberg | 162/110 |
| 334,199 | 1/1886 | Schmidt | 101/32 |
| 1,479,337 | 1/1924 | Temple | 162/110 |
| 2,021,141 | 11/1935 | Boyer | 106/25 |
| 3,048,100 | 8/1962 | Livingstone | 101/491 |
| 3,985,927 | 11/1976 | Norris et al. | 428/211 |
| 4,231,906 | 11/1980 | Giorgetti . | |
| 4,824,486 | 4/1989 | Lafler | 106/30 |

*Primary Examiner*—Evan Lawrence

[57] ABSTRACT

A method of producing a simulated watermark in which intense, focused heat is momentarily applied, in the desired watermark pattern, onto a thin solid matrix of waxy material placed in contact with a sheet of uncoated paper. This results in impression of a durable translucent mark. The wax penetrates the paper without the need wither for chemical action or the application of significant direct pressure, and creates regions of translucence in the paper fibers.

5 Claims, No Drawings

METHOD OF PRODUCING A SIMULATED WATERMARK

BACKGROUND OF THE INVENTION

A. Field of the Invention

The invention relates generally to production of simulated watermarks, and more particularly to a process for depositing on uncoated, stationery-grade paper an image similar to a traditional watermark.

B. Description of the Related Art

Watermarking refers to the placement of a faint, permanent image on a sheet of paper. The image can serve to identify the manufacturer of the paper or its user, and/or may contain information relating to date of manufacture or paper composition.

The traditional method of watermarking involves mechanically impressing the design onto the fibers of the paper as it is being manufactured, and while it is still wet. Typically, metal rollers having the design embossed thereon are interposed between the wet paper web emerging from a vessel of aqueous pulp and drying equipment. The rollers are brought into intimate rolling contact with the web, displacing the paper fibers slightly and thereby varying the thickness of the sheet in that area. After drying, the affected area remains permanently translucent when viewed under transmitted light, and the paper web may be cut into individual sheets.

Because this "wet-laid" process is economical only for very large quantities of paper, practitioners have developed a number of processes that simulate the look of a watermark, but which may be applied at low cost to a relatively small number of cut sheets. As far as we are aware, all of these alternative processes involve chemical treatment.

A number of early attempts to produce imitation watermarks involved direct application of colorless resin solutions to dried, finished paper. Penetration of the paper by the resin solution reduced the paper's opacity. Unfortunately, once introduced into the paper, the resins tended to turn yellow in a relatively short period of time, resulting in an unsightly appearance. Other chemical processes involve complex formulations, make use of curing agents which are or give rise to disagreeable vapors or byproducts, require excessive periods of time or special equipment to cure, are difficult to apply, and/or degrade the strength and stability of the paper to which they are applied.

We are also aware of an early attempt to impregnate paper with wax, described in U.S. Pat. No. 1,479,337. In this process, a waxy material is combined with a solvent to produce a liquid or paste, which is applied to the paper from the rollers of a printing press. The solvent carries the wax into the paper fibers, reducing the opacity of the paper. This technique requires use of a full-scale printing press which, in addition to its expense, can create pressure marks on the paper. The method also necessitates manual preparation and maintenance of the waxy liquid material, as well as its repeated application to a printing plate.

SUMMARY OF THE INVENTION

Accordingly, it is an object of the invention to provide a method of producing simulated watermarks that does not require the use or application of chemicals that react with the paper.

Another object of the invention is to teach a system of economically printing stationery and other uncoated paper with indicia bearing a watermark appearance when viewed from either side of the sheet.

It is a further object of the invention to provide an economical method of producing simulated watermarks that utilizes low-cost hot-stamping equipment.

It is yet another object of the invention to produce stable simulated watermarks that do not affect the stability or strength of the paper to which they are applied.

Other objects will, in part, be obvious and will, in part, appear hereinafter. The invention accordingly comprises the several steps and the relation of one or more of such steps with respect to the others and the apparatus embodying the features of construction, combination of elements and the arrangement of parts which are adapted to effect such steps, all as exemplified in the following summary and detailed description, and the scope of the invention will be indicated in the claims.

We have discovered, surprisingly, that momentary application of intense, focused heat onto a thin solid matrix of waxy material placed in contact with a sheet of uncoated paper results in the impression of a durable translucent mark. The wax penetrates the paper without the need either for chemical action or the application of significant direct pressure, and creates regions of translucence in the paper fibers. The designs formed by these regions bear an entirely satisfactory resemblance to a traditional watermark.

DESCRIPTION OF THE PREFERRED EMBODIMENT

The waxy material that we prefer to use is provided on relatively thin backing sheets, which should be heavily coated on one side with the wax. One suitable product is the waxed paper ordinarily used for household wrapping purposes, an example being that marketed under the trademark "Cut-Rite" by the Consumer Products Division of Reynolds Metal Company, Richmond, Va. However, we believe that any number of commercially available composite materials having exposed wax layers and exposed heat-resistant layers would also serve advantageously. Furthermore, although sheets coated with wax on only one side are preferred as a matter of convenience, our process can also be used with sheets coated with wax on both sides; the relatively minor amount of wax that accumulates on the stamping die can be cleaned periodically with minimal effort.

We have found that, in order to effect transfer of the wax into the paper, the temperature of the applied heat should range from 200° F. to 275° F; both above and below this range, wax does not transfer effectively, and high temperatures can also cause damage to the paper. The optimal temperature is determined by the characteristics of the wax matrix. The heat should also be applied for less than one second, since excessively long exposures to heat can cause transfer of too much wax, resulting in surface buildup and/or excessive spreading of the wax; the latter tendency can cause unwanted bolding of the watermark design.

Our preferred means of heat application is a hot, letterpress stamping apparatus. These relatively inexpensive devices, well-known in the art, can be adjusted to exert little pressure on contact so as to avoid producing indentations; the temperature of the contact die, as well as its contact dwell time, can also be varied. We use dwell times substantially less than one second, preferably 1/10 to 1/15 second.

In practicing our invention, we prepare a hot-stamping die that contains the desired watermark design raised in relief. The design "reads right"; that is, the relief pattern appears as a correct, non-reversed rendition of the design to a viewer inspecting the die. We place a sheet of the waxed material on the paper to be treated (preferably the back side, if one is identifiable), and adjust the stamping apparatus to make light contact with the backing sheet of the waxed material. We are then ready to raise the temperature of the stamping die and begin stamping.

The technique is amenable to use with individual cut sheets, but is most economically applied to a continuous web of paper. When using a web, the waxed material can accompany the paper in a continuous feed, or be positioned in small pieces at locations where the die will strike. We believe that this method can be used advantageously with virtually any type of uncoated paper.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of applying a simulated watermark to a sheet of uncoated paper, comprising the steps of:

a. placing a sheet of waxed material in contact with one side of the paper; and b. momentarily applying, in a pattern representative of a desired design, sufficient heat to melt the wax and cause its entry into the paper.

2. The method of claim 1 wherein the heat is applied by a solid member with sufficiently small pressure to avoid producing indentations on the paper.

3. The method of claim 1 wherein the sheet of waxed material contains a heavy coating of wax on at least one side thereof.

4. The method of claim 1 wherein the heat is applied by a solid member whose temperature ranges from 200° F. to 275° F.

5. The method of claim 4 wherein the heat is applied for a period of time not exceeding 1/10 second.

* * * * *